US011074851B2

(12) United States Patent
Fang et al.

(10) Patent No.: US 11,074,851 B2
(45) Date of Patent: Jul. 27, 2021

(54) DRIVING APPARATUS FOR A DISPLAY PANEL

(71) Applicant: Novatek Microelectronics Corp., Hsinchu (TW)

(72) Inventors: Po-Hsiang Fang, Hsinchu (TW); Tzong-Honge Shieh, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/937,598

(22) Filed: Jul. 24, 2020

(65) Prior Publication Data

US 2020/0365073 A1 Nov. 19, 2020

Related U.S. Application Data

(63) Continuation of application No. 15/917,852, filed on Mar. 12, 2018, now Pat. No. 10,777,120.

(60) Provisional application No. 62/542,763, filed on Aug. 8, 2017.

(51) Int. Cl.
*G09G 3/20* (2006.01)

(52) U.S. Cl.
CPC ..... *G09G 3/2096* (2013.01); *G09G 2310/027* (2013.01); *G09G 2310/0291* (2013.01);
(Continued)

(58) Field of Classification Search
CPC ..... G09G 3/2096; G09G 2310/0297; G09G 2370/045; G09G 2350/00; G09G 2310/08;
(Continued)

(56) References Cited

U.S. PATENT DOCUMENTS

2003/0156107 A1* 8/2003 Sakashita ..... G09G 5/008 345/213
2004/0257328 A1* 12/2004 Lim ..... G09G 3/3688 345/100
(Continued)

FOREIGN PATENT DOCUMENTS

CN 101425247 5/2009
CN 101727809 6/2010
(Continued)

OTHER PUBLICATIONS

"Office Action of China Counterpart Application", dated Apr. 21, 2021, p. 1-p. 8.

*Primary Examiner* — Abbas I Abdulselam
(74) *Attorney, Agent, or Firm* — JCIPRNET

(57) ABSTRACT

A driving apparatus capable of driving a display panel is provided. The driving apparatus can include a multiplexer and an output circuit. The multiplexer may include at least one first input terminal configured to receive information data in a first mode, at least one second input terminal configured to receive display data in a second mode, and at least one output terminal coupled to at least one input terminal of the output circuit. The output circuit can be configured to convert digital data into an analog voltage and output the analog voltage via at least one output terminal of the output circuit. The output circuit can be configured to convert the information data in the first mode and convert the display data into at least one driving voltage for driving at least one data line of the display panel in the second mode. The information data cannot be used for driving the display panel to present an image.

19 Claims, 8 Drawing Sheets

(52) U.S. Cl.
CPC . *G09G 2310/0297* (2013.01); *G09G 2310/08* (2013.01); *G09G 2330/12* (2013.01); *G09G 2350/00* (2013.01); *G09G 2370/045* (2013.01)

(58) Field of Classification Search
CPC ..... G09G 2310/0291; G09G 2310/027; G09G 2330/12
See application file for complete search history.

(56) References Cited

U.S. PATENT DOCUMENTS

| | | | | |
|---|---|---|---|---|
| 2006/0022930 | A1 | 2/2006 | Chen et al. | |
| 2006/0267623 | A1 | 11/2006 | Yoo | |
| 2009/0284545 | A1* | 11/2009 | Watanabe | G09G 3/3611 345/589 |
| 2010/0091009 | A1 | 4/2010 | Uchiyama | |
| 2011/0001687 | A1* | 1/2011 | Srinivasan | G06F 3/1462 345/3.1 |
| 2011/0169797 | A1* | 7/2011 | Song | G09G 3/3688 345/209 |
| 2016/0275897 | A1* | 9/2016 | Lin | G09G 3/3648 |
| 2016/0379538 | A1 | 12/2016 | Yan | |
| 2017/0168615 | A1 | 6/2017 | Huang | |

FOREIGN PATENT DOCUMENTS

| | | |
|---|---|---|
| CN | 102737570 | 10/2012 |
| CN | 104916250 | 9/2015 |
| CN | 106886743 | 6/2017 |

* cited by examiner

DRIVING APPARATUS FOR A DISPLAY PANEL

CROSS-REFERENCE TO RELATED APPLICATION

This application is a continuation application claiming the benefit of US application Ser. No. 15/917,852, filed on Mar. 12, 2018, now allowed, which claims the priority benefit of U.S. provisional application Ser. No. 62/542,763, filed on Aug. 8, 2017. The entirety of the above-mentioned patent application is hereby incorporated by reference herein and made a part of this specification.

BACKGROUND

Field of the Invention

The invention relates to a display apparatus and more particularly, to a driving apparatus for a display panel.

Description of Related Art

Generally, a driving apparatus can drive a display panel to present images. The driving apparatus may include a source driver and/or a gate driver. At present, a receiver circuit of the source driver receives pixel data from a timing controller (TCON), and then a digital-to-analog converter (DAC) of the source driver outputs a corresponding driving voltage, through operational amplifiers, to data lines of the display panel to drive the display panel to present images. If information data in the driving apparatus (i.e., an integrated circuit) has to be transmitted to other circuits (for example, a timing controller, a test apparatus or other integrated circuits), a conventional driving apparatus requires additional pins for outputting the information data. Based on a design demand, the information data in the driving apparatus may be state information of a state machine, bit error information, lock-status information and so on. If a great amount of bit data or complex data are to be transmitted, the conventional driving apparatus requires to transmit the data through additional interfaces (for example, an LVDS interface, an $I^2C$ interface or a custom-defined protocol interface). One can imagine that these additional pins and additional interfaces will lead to the increase in the area of the integrated circuit as well as the increase in the cost of package.

SUMMARY

The invention provides a driving apparatus for a display panel capable of outputting information data to other circuits/apparatuses on a premise that no additional pins are required.

According to an embodiment of the invention, a driving apparatus capable of driving a display panel is provided. The driving apparatus includes a multiplexer and an output circuit. The multiplexer comprises at least one first input terminal configured to receive information data in a first mode, at least one second input terminal configured to receive display data in a second mode, and at least one output terminal coupled to at least one input terminal of the output circuit. The output circuit is configured to convert digital data into an analog voltage, and output the analog voltage via at least one output terminal of the output circuit. The output circuit is configured to convert the information data in the first mode and convert the display data into at least one driving voltage for driving at least one data line of the display panel in the second mode. The information data is not used for driving the display panel to present an image.

According to an embodiment of the invention, a driving apparatus capable of driving a display panel is provided. The driving apparatus includes an output circuit, a first receiver circuit, a second receiver circuit and a multiplexer. The output circuit is configured to convert digital data into an analog voltage and output the analog voltage via at least one output terminal of the output circuit. The multiplexer includes at least one first input terminal coupled to the first receiver circuit, at least one second input terminal coupled to the second receiver circuit, and at least one output terminal coupled to at least one input terminal of the output circuit. The multiplexer is configured to selectively output first data received from the at least one first input terminal and second data received from the at least one second input terminal.

Based on the above, the driving apparatus for the display panel provided by the embodiments of the invention can achieve outputting the information data and the display data by sharing the first output circuit. Thus, in some embodiments, the driving apparatus can achieve transmitting the complex information data on the premise that no additional pins are required, thereby saving the pin count. On the other hand, in some embodiments, a plurality of output channels of the first output circuit can simultaneously output the information data. Thus, the driving apparatus can achieve transmitting a great amount of information data within a short time, so as to save a transmission time of the information data. The saving of the transmission time can especially contribute to the efficiency of a testing procedure of integrated circuits.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
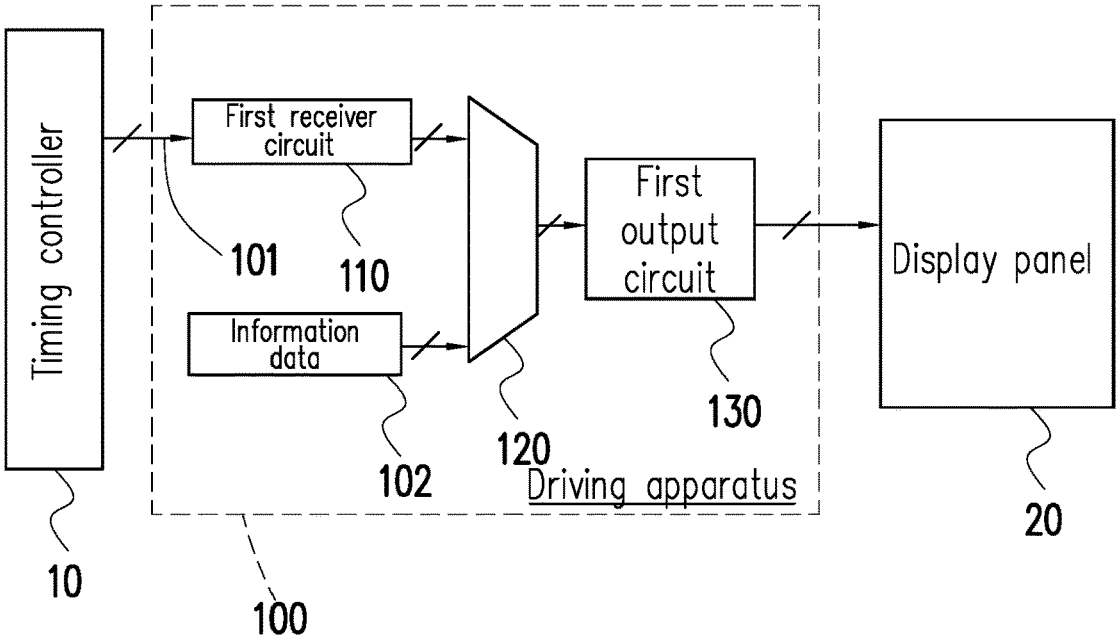
FIG. 1A and FIG. 1B are schematic circuit block diagrams illustrating a driving apparatus for a display panel according to an embodiment of the invention.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referral numerals in the drawings and description refer to the same or like parts. Components/members/steps using the same referral numerals or using the same terms in different embodiments may cross-refer related descriptions.

Figure 1B:
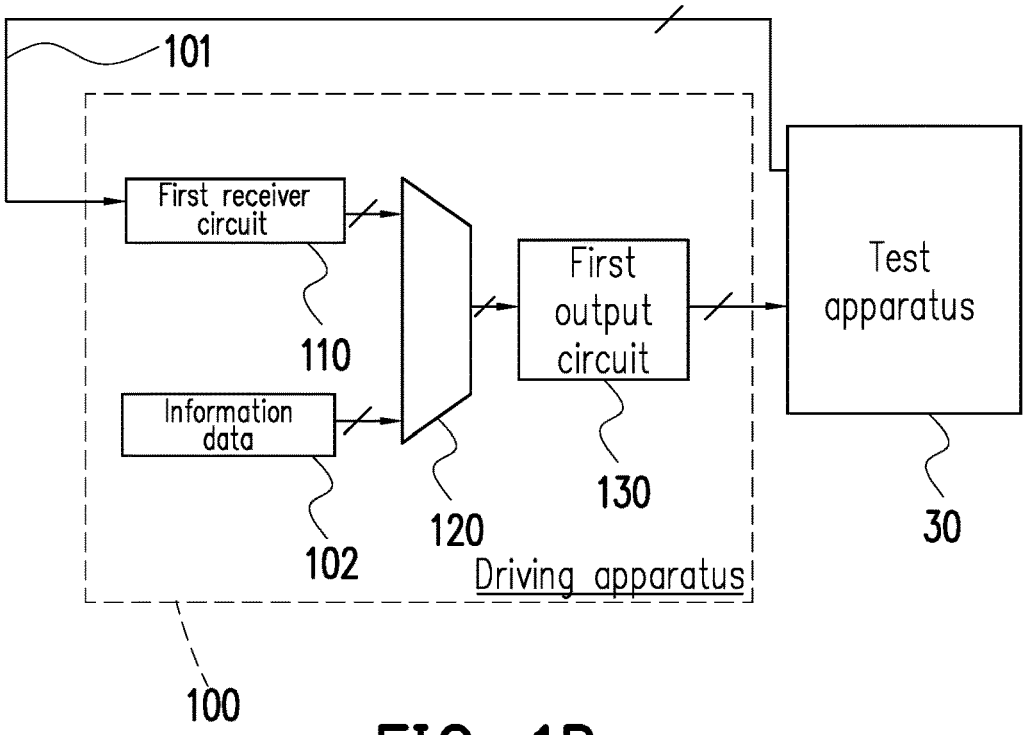

FIG. 1A and FIG. 1B are schematic circuit block diagrams illustrating a driving apparatus 100 for a display panel according to an embodiment of the invention. According to the control of a timing controller 10, the driving apparatus 100 may drive a display panel 20. Based on a design demand, the display panel 20 may be a liquid crystal display (LCD) panel, an organic light emitting diode (OLED) display panel or any other type display panel. In the embodiment illustrated in FIG. 1A and FIG. 1B, the driving apparatus 100 may serve as a source driver of the display panel 20. Based on a design demand, in other embodiments, the driving apparatus 100 may also include a gate driver.

The driving apparatus 100 includes a first receiver circuit 110, a multiplexer 120 and a first output circuit 130. Based on a design demand, in some embodiments, the first receiver circuit 110 may include a built-in self-test (BIST) pattern generation circuit (which is not shown). In a test mode, the BIST pattern generation circuit may generate image data indicating at least one predetermined image pattern to the first output circuit 130 through the multiplexer 120. The first output circuit 130 may generate/output at least one driving voltage according to the image data of the BIST pattern generation circuit. In some other embodiments, the first receiver circuit 110 may not include the BIST pattern generation circuit.

Figure 2:
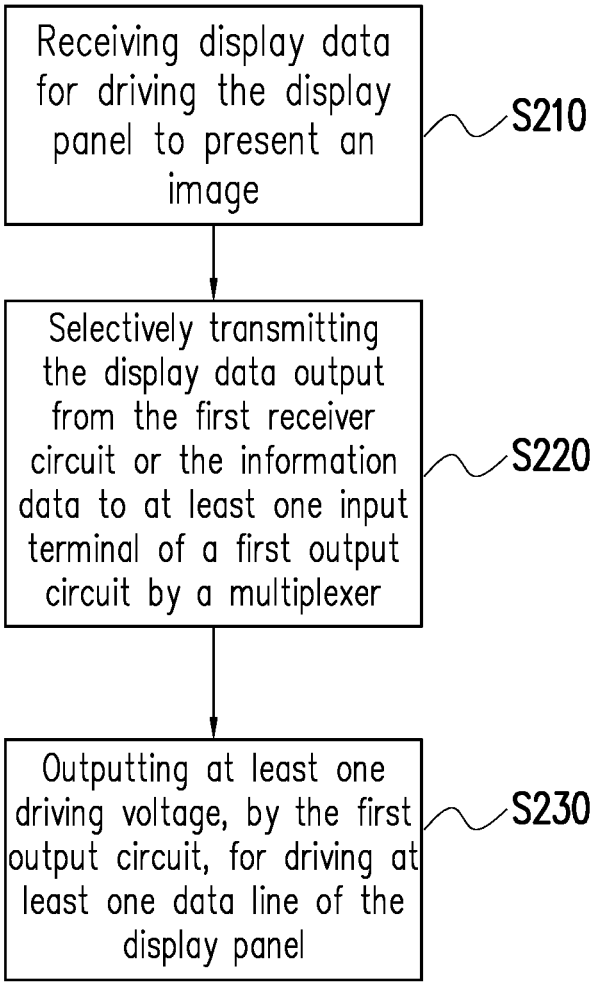
FIG. 2 is a flowchart illustrating an operation method of the driving apparatus for the display panel according to an embodiment of the invention.

FIG. 2 is a flowchart illustrating an operation method of the driving apparatus 100 for the display panel according to an embodiment of the invention. Referring to FIG. 1A (or FIG. 1B) and FIG. 2. In step S210, the first receiver circuit 110 receives display data 101. At least one first input terminal of the multiplexer 120 may receive information data 102. Therein, the display data 101 is configured to drive the display panel to present an image, while the information data 102 is not configured to drive the display panel to present the image. Based on a design demand, the information data 102 may be any information related to the driving apparatus 100, but not include pixel data. For instance, the information data 102 may include a bit error number, analog-to-digital bit information, state information and/or other information (which does not include pixel data) of the driving apparatus 100. At least one second input terminal of the multiplexer 120 is coupled to at least one output terminal of the first receiver circuit 110 to receive the display data. At least one output terminal of the multiplexer 120 is coupled to at least one input terminal of the first output circuit 130.

In step S220, the multiplexer 120 may selectively transmit the information data 102 or the display data 101 output by the first receiver circuit 110 to an input terminal of the first output circuit 130. The first output circuit 130 may convert digital data of the input terminal of the first output circuit 130 into an analog voltage and output the analog voltage through at least one output terminal of the first output circuit 130. In step S230, the at least one output terminal of the first output circuit 130 may output at least one driving voltage. The driving voltage may be configured to drive at least one data line of the display panel 20.

FIG. 1A is the schematic diagram illustrating a scenario that the driving apparatus 100 is applied in a display apparatus product. In the implementation example illustrated in FIG. 1A, the first receiver circuit 110 receives the display data 101 from the timing controller 10. The multiplexer 120 may select to transmit the display data of the first receiver circuit 110 to the first output circuit 130. Thus, the first output circuit 130 may convert the display data into the corresponding driving voltage. The first output circuit 130 is coupled to the at least one data line of the display panel 20 to output at least one driving voltage for driving the display panel 20 to present the image. Based on a design demand, timing controller 10 may be a conventional timing controller or any other timing controller circuit, and the display panel 20 may be a conventional display panel or any other display panel and thus, will not be repeatedly described.

When the driving apparatus 100 is operated in a normal operation mode, the multiplexer 120 may selectively transmit the display data of the first receiver circuit 110 to the input terminal of the first output circuit 130, such that the first output circuit 130 may drive the at least one data line of the display panel 20. When the driving apparatus 100 is operated in a particular mode, the multiplexer 120 may selectively transmit the information data 102 to the input terminal of the first output circuit 130.

FIG. 1B is a schematic diagram illustrating that the driving apparatus 100 is tested in a test environment. In the implementation example illustrated in FIG. 1B, the first receiver circuit 110 receives the display data 101 from a test apparatus 30. Based on a design demand, the test apparatus 30 may be a conventional testing platform/circuit or any other test apparatus and thus, will not be repeatedly described. When the driving apparatus 100 is operated in the normal operation mode, the multiplexer 120 may selectively transmit the display data of the first receiver circuit 110 to the input terminal of the first output circuit 130, such that the first output circuit 130 may output a driving voltage corresponding to the display data to the test apparatus 30. Thereby, the test apparatus 30 may verify whether the driving voltage output by the driving apparatus 100 may meet the display data 101 provided by the test apparatus 30.

When the driving apparatus 100 is operated in the particular mode, the multiplexer 120 may selectively transmit the information data 102 to the input terminal of the first output circuit 130. In some embodiments, the information data 102 may indicate operation information of the driving apparatus 100. In the particular mode, the first output circuit 130 may convert the information data 102 in a digital format into the analog voltage and output the analog voltage (i.e., the information data 102 in an analog format) to the test apparatus 30 through the at least one output terminal of the first output circuit 130. Thereby, the test apparatus 30 may verify whether the operation of the driving apparatus 100 may meet expectations.

Figure 3:
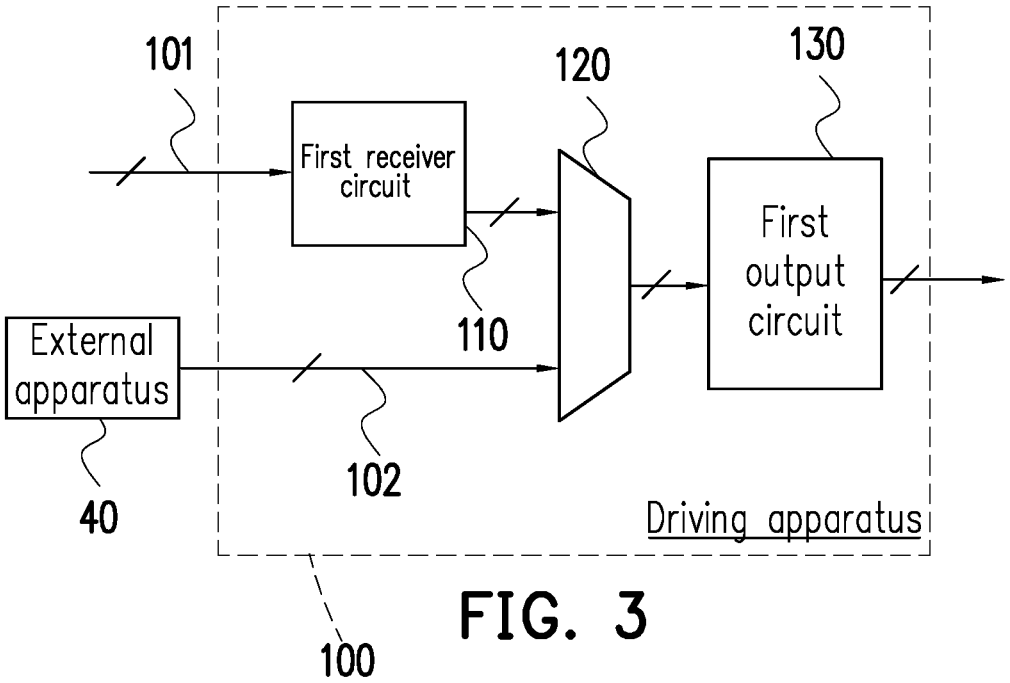
FIG. 3 is a schematic diagram illustrating a source providing the information data of the driving apparatus depicted in FIG. 1 according to an embodiment of the invention.

FIG. 3 is a schematic diagram illustrating a source providing the information data 102 of the driving apparatus 100 depicted in FIG. 1 according to an embodiment of the invention. In the embodiment illustrated in FIG. 3, the driving apparatus 100 is further coupled to an external device 40. Based on a design demand, the external device 40 may be a device (e.g., a printed circuit board), a display panel, a test apparatus or any other device/circuit including a timing controller. The external device 40 may provide external information to the driving apparatus 100, such that the driving apparatus 100 may obtain the information data 102. Taking the circuit illustrated in FIG. 3 as an example, the driving apparatus 100 may receive the external information from the external device 40 and directly serve it as the information data 102. In other embodiments, the driving apparatus 100 may process the external information provided from the external device 40 to obtain the information data 102.

For instance, it is assumed that the external device 40 may be an OLED display panel, and the external information may be a voltage (or current) sensing result of the OLED display panel. In the particular mode, the first output circuit 130 may obtain the voltage (or current) sensing result of the OLED display panel through the multiplexer 120. The first output circuit 130 may output the voltage (or current) sensing result to another external device (for example, a timing controller or a test apparatus which is not shown) through the at least one output terminal of the first output circuit 130.

Figure 4:
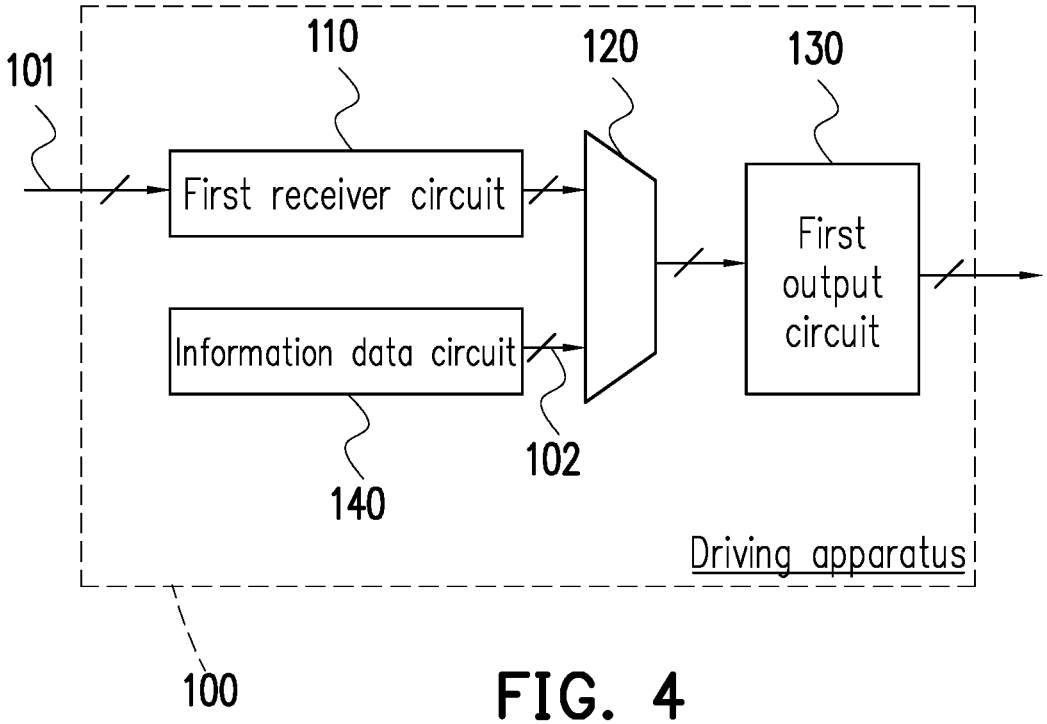
FIG. 4 is a schematic diagram illustrating a source providing the information data of the driving apparatus depicted in FIG. 1 according to another embodiment of the invention.

FIG. 4 is a schematic diagram illustrating a source providing the information data 102 of the driving apparatus 100 depicted in FIG. 1 according to another embodiment of the invention. In the embodiment illustrated in FIG. 4, the driving apparatus 100 further includes an information data circuit 140. The information data circuit 140 may provide the information data 102 to the multiplexer 120. In the embodiment illustrated in FIG. 4, the information data circuit 140 may internally generate information data 102 rather than receiving any information from any external apparatuses. For instance, the information data circuit 140 may include a state information register of a finite state machine of the driving apparatus 100. The state information register may provide state information of the driving apparatus 100 to serve it as the information data 102. In other embodiments, the information data circuit 140 may receive external information from an external apparatus and correspondingly generate the information data 102 according to the external information.

Figure 5:
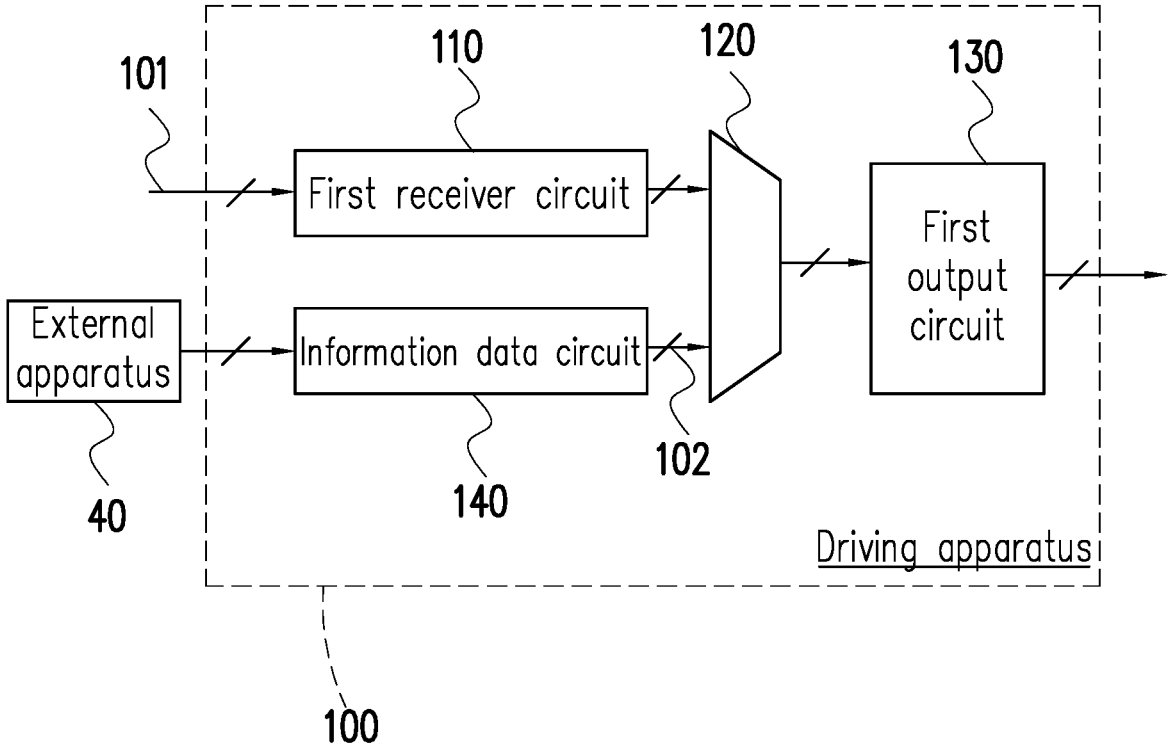
FIG. 5 is a schematic diagram illustrating a source providing the information data of the driving apparatus depicted in FIG. 1 according to yet another embodiment of the invention.

FIG. 5 is a schematic diagram illustrating a source providing the information data 102 of the driving apparatus 100 depicted in FIG. 1 according to yet another embodiment of the invention. In the embodiment illustrated in FIG. 5, the information data circuit 140 of the driving apparatus 100 is coupled to an external device 40. The external device 40 illustrated in FIG. 5 may refer to the related description of that illustrated in FIG. 3 and thus, will not be repeatedly described. The external device 40 may provide the external information to the information data circuit 140. The information data circuit 140 may generate the information data 102 according to the external information to the multiplexer 120.

Figure 6A:
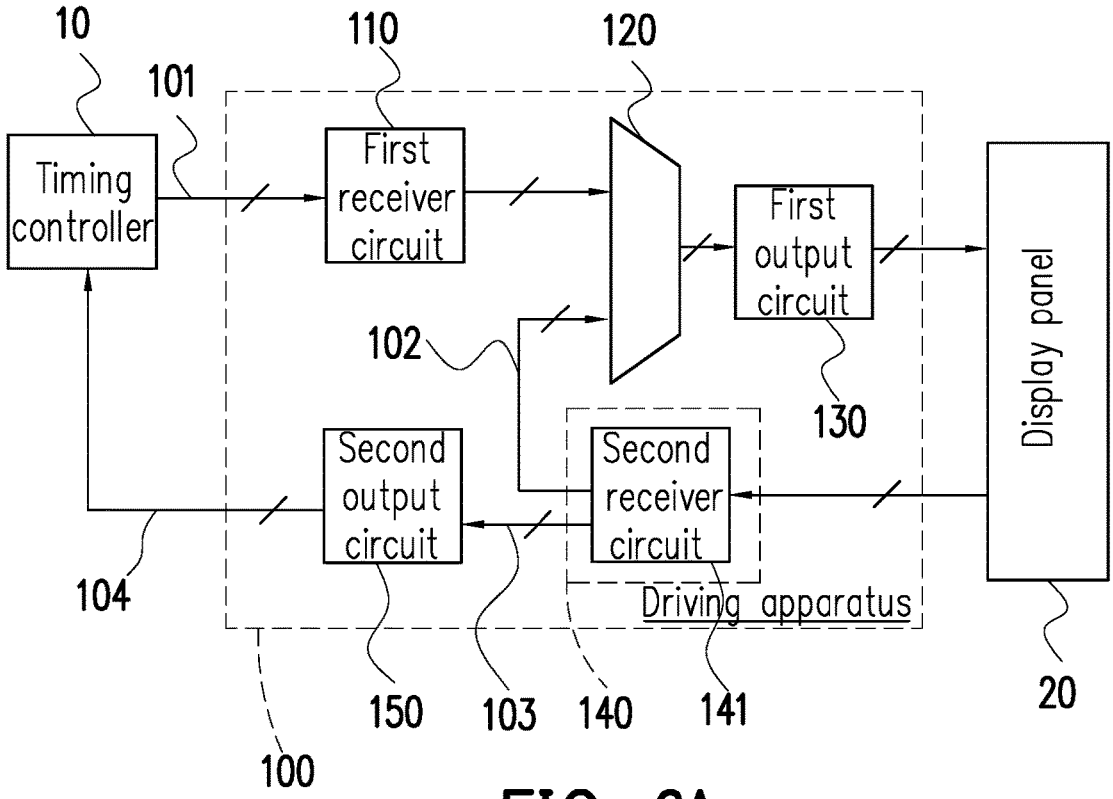
FIG. 6A and FIG. 6B are schematic diagrams illustrating that the driving apparatus depicted in FIG. 5 is applied in various environments according to an embodiment of the invention.
Figure 6B:
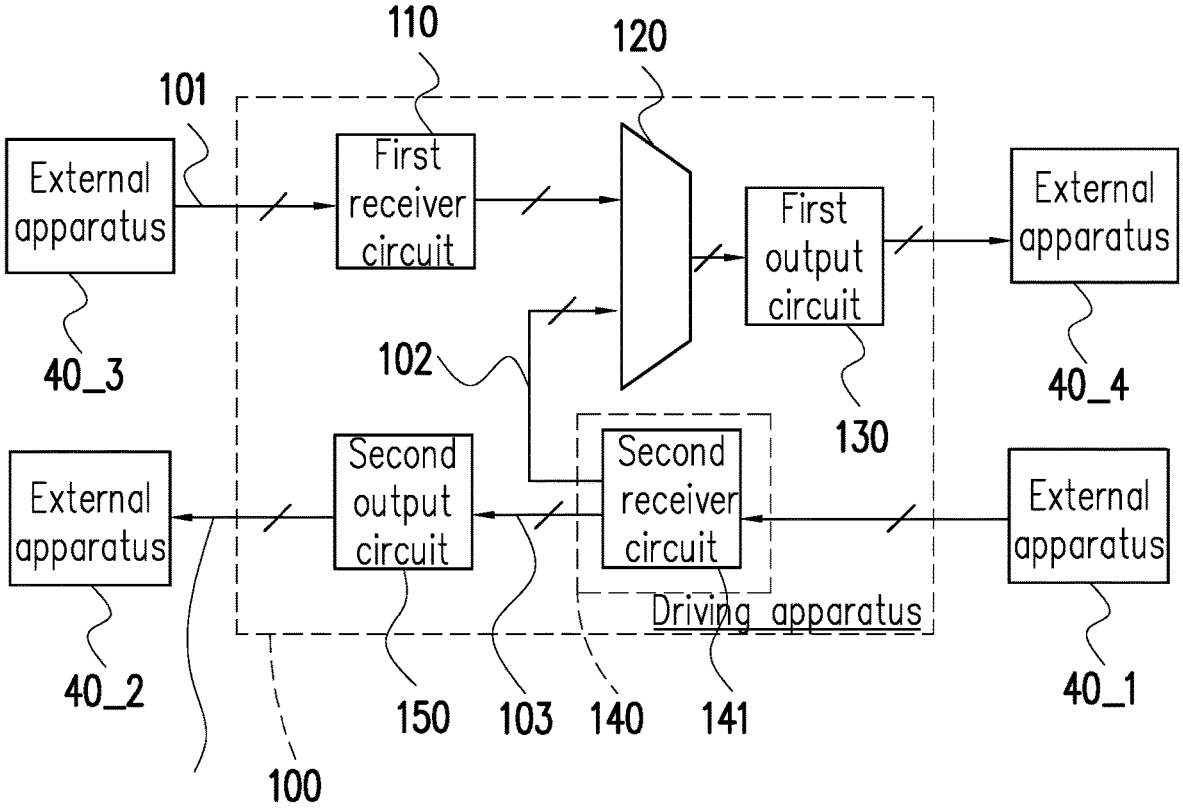

FIG. 6A and FIG. 6B are schematic diagrams illustrating that the driving apparatus 100 depicted in FIG. 5 is applied in various environments according to an embodiment of the invention. In the implementation examples illustrated in FIG. 6A and FIG. 6B, the information data circuit 140 of the driving apparatus 100 includes a second receiver circuit 141, and the driving apparatus 100 further includes a second output circuit 150.

FIG. 6A is the schematic diagram illustrating a scenario that the driving apparatus 100 is applied in a display apparatus product. FIG. 6B is a schematic diagram illustrating that the driving apparatus 100 is tested in a test environment illustrated in FIG. 5. In the particular mode, the second receiver circuit 141 may receive the external information from the external device 40_1 and generate the information data 102 according to the external information to the multiplexer 120. In normal mode, the second receiver circuit 141 may convert the voltage (or current) sensing result of the display panel 20 into sensing data 103 and provide it to the second output circuit 150. The second output circuit 150 may, in normal mode, receive the sensing data 103 output by the second receiver circuit 141. According to the received sensing data 103, the second output circuit 150 may provide output data 104 to the timing controller 10 illustrated in FIG. 6A or the external device 40_2 illustrated in FIG. 6B.

The first receiver circuit 110 receives the display data 101 from the timing controller 10 illustrated in FIG. 6A or the external device 40_3 illustrated in FIG. 6B. The multiplexer 120 may select to transmit the display data of the first receiver circuit 110 to the first output circuit 130 in the normal mode, and transmit the information data 102 to the first output circuit 130 in the particular mode. Thus, the first output circuit 130 may convert the data output from the first output circuit 130 into the corresponding voltage, and output the corresponding voltage to the external device 40_4. The external devices 40_1 to 40_4 may be the same apparatus or different apparatus. For example, the external devices 40_1 to 40_4 may be the test apparatus 30 illustrated in FIG. 1B.

Figure 7:
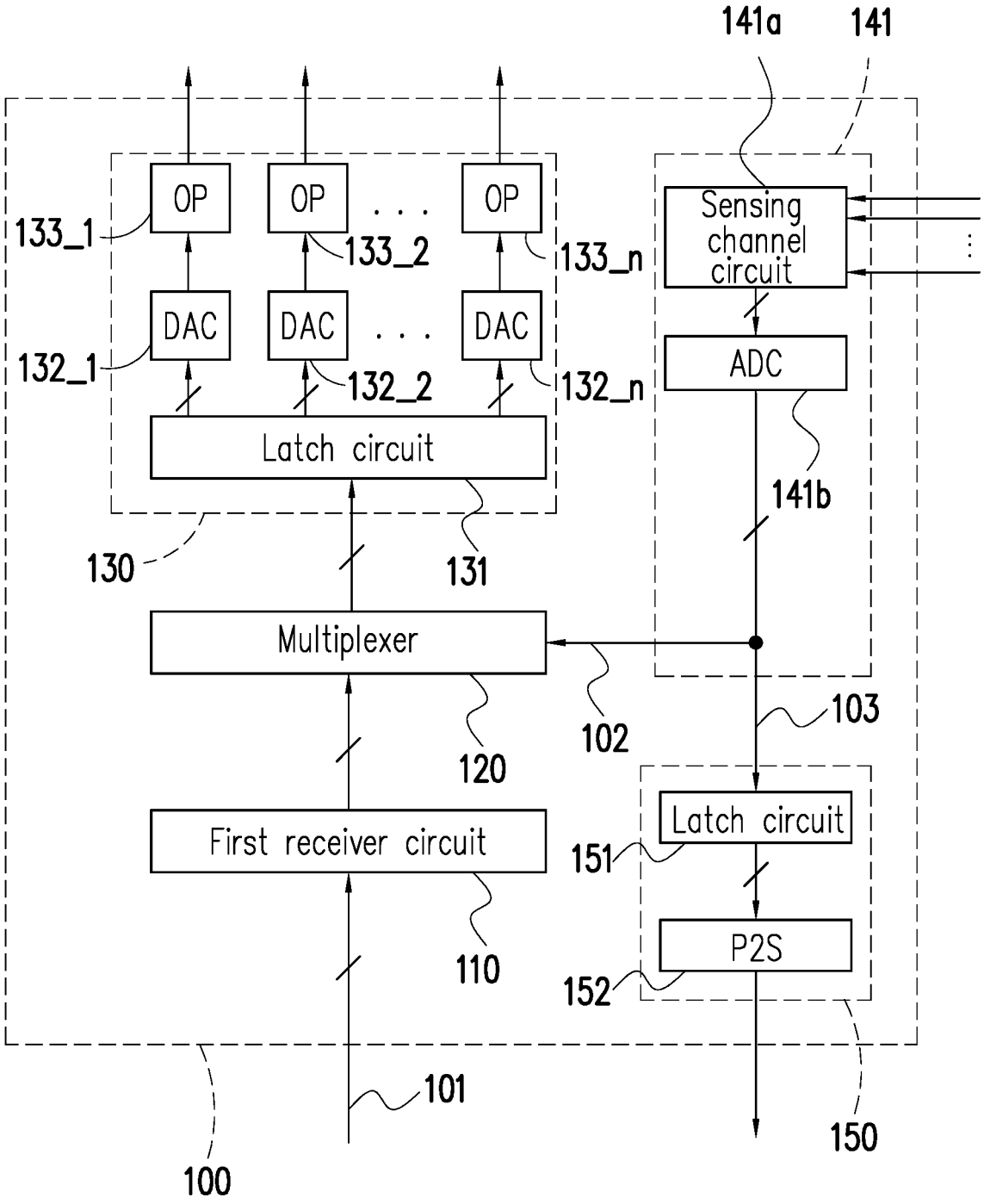
FIG. 7 is a schematic circuit block diagram illustrating the first output circuit, the second receiver circuit and the second output circuit depicted in FIG. 6A and FIG. 6B according to an embodiment of the invention.

FIG. 7 is a schematic circuit block diagram illustrating the first output circuit 130, the second receiver circuit 141 and the second output circuit 150 depicted in FIG. 6A and FIG. 6B according to an embodiment of the invention. In the embodiment illustrated in FIG. 7, the first output circuit 130 includes a latch circuit 131 and at least one digital-to-analog converter (DAC), for example, DACs 132_1, 132_2, . . . and **132_*n* illustrated in FIG. 7. The latch circuit 131 may receive and latch the output from the multiplexer 120 and output latched data to the DACs 132_1 to 132_*n*. The DACs 132_1 to 132_*n* may convert the digital data into an analog voltage. The first output circuit 130 further includes at least one operational amplifier (OP), for example, OPs 133_1, 133_2, . . . and 133_*n* illustrated in FIG. 7. Input terminals of the OPs 133_1 to 133_*n* are respectively coupled to output terminals of the DACs 132_1 to 132_*n* to receive the analog voltage. When the driving apparatus 100 is coupled to the display panel 20, output terminals of the OPs 133_1 to 133_*n* may be respectively coupled to different data lines of the display panel 20**.

In the embodiment illustrated in FIG. 7, the second receiver circuit 141 includes a sensing channel circuit **141*a* and an analog-to-digital converter (ADC) 141*b*. When the driving apparatus 100 is coupled to the display panel 20, an input terminal of the sensing channel circuit 141*a* may be coupled to a sensing terminal of the display panel 20. The sensing channel circuit 141*a* may sense a voltage (or a current) of the display panel 20 to output a voltage (or current) sensing result to the ADC 141*b*. An input terminal of the ADC 141*b* is coupled to an output terminal of the sensing channel circuit 141*a*. The ADC 141*b* may convert the voltage (or current) sensing result into at least one digital signal. In the embodiment illustrated in FIG. 7, the at least one digital signal may be directly provided to the multiplexer 120 to serve as the information data 102, and the at least one digital signal may be directly provided to the second output circuit 150 to serve as the sensing data 103**.

In the embodiment illustrated in FIG. 7, the second output circuit 150 includes a latch circuit 151 and a parallel-to-serial (P2S) circuit 152. An input terminal of the latch circuit 151 is coupled to an output terminal of the second receiver circuit 141. The latch circuit 151 may latch the sensing data 103 (or the information data 102) from the second receiver circuit 141. An input terminal of the P2S circuit 152 is coupled to an output terminal of the latch circuit 151. The P2S circuit 152 may convert the sensing data 103 (or the information data 102) in a parallel format into a serial format. When the driving apparatus 100 is coupled to the timing controller 10, the input terminal of the sensing channel circuit 141*a* may be coupled to a sensing signal input terminal of the timing controller 10.

Figure 8:
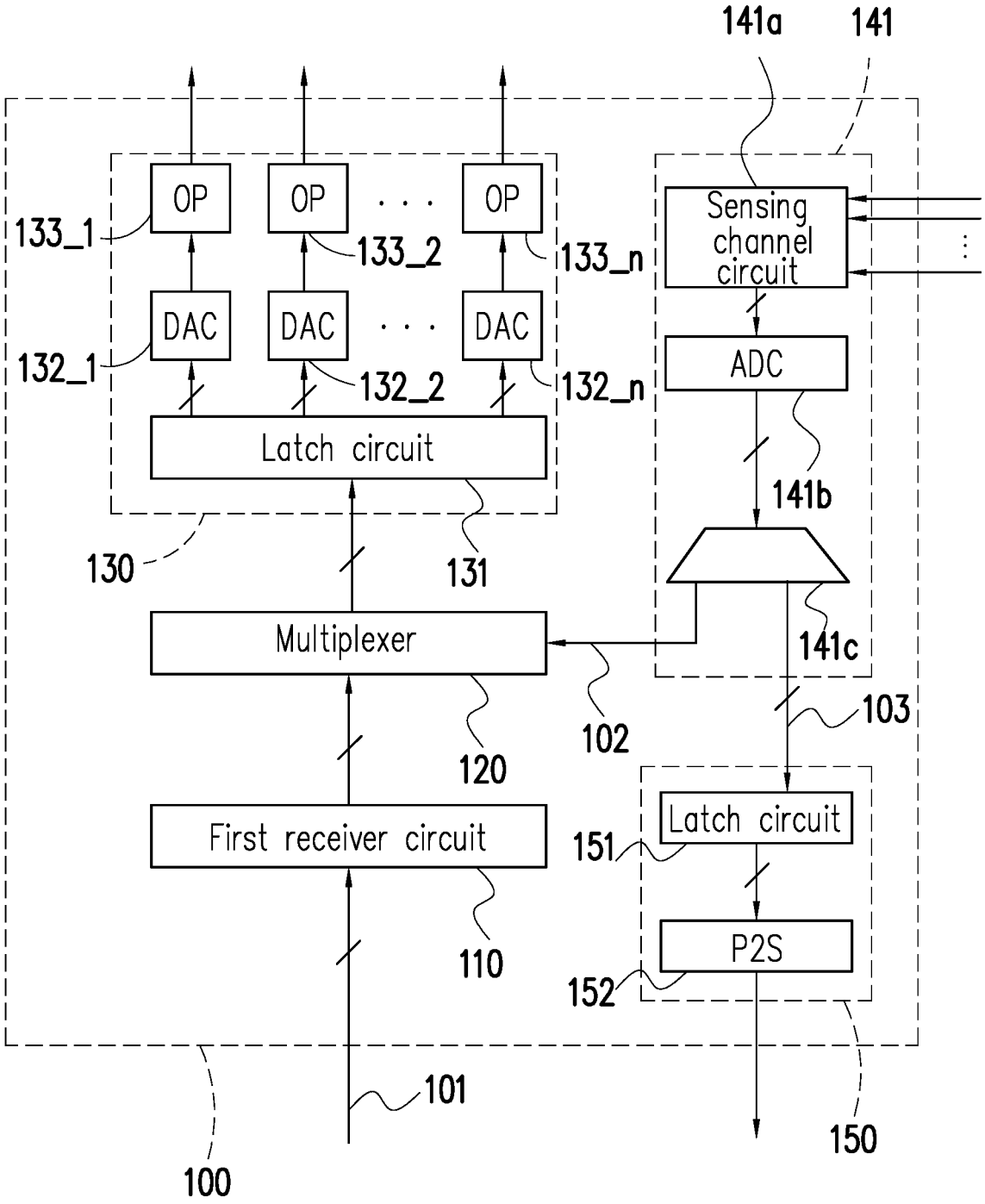
FIG. 8 is a schematic circuit block diagram illustrating the second receiver circuit depicted in FIG. 6A and FIG. 6B according to another embodiment of the invention.

FIG. 8 is a schematic circuit block diagram illustrating the second receiver circuit 141 depicted in FIG. 6A and FIG. 6B according to another embodiment of the invention. The second receiver circuit 141 includes a sensing channel circuit 141*a*, an ADC 141*b* and a demultiplexer 141*c*. The first output circuit 130, the latch circuit 131, the DAC s 132_1 to 132_*n*, the OPs 133_1 to 133_*n*, the second receiver circuit 141, the sensing channel circuit 141*a*, the ADC 141*b*, the second output circuit 150, the latch circuit 151 and the P2S circuit 152 illustrated in FIG. 8 may refer to the related descriptions of those illustrated in FIG. 7 and thus, will not be repeatedly described.

In the embodiment illustrated in FIG. 8, at least one input terminal of the demultiplexer 141*c* is coupled to at least one output terminal of the ADC 141*b*. At least one first output terminal of the demultiplexer 141*c* is coupled to the at least one first input terminal of the multiplexer 120 to provide the information data 102. At least one second output terminal of the demultiplexer 141*c* is coupled to at least one input terminal of the second output circuit 150 to provide the sensing data 103. When the driving apparatus 100 is operated in the normal operation mode, the demultiplexer 141*c* may selectively transmit the digital signal output by the ADC 141*b* to the second output circuit 150 to serve it as the sensing data 103. When the driving apparatus 100 is operated in the particular mode (e.g., a test mode), the demultiplexer 141*c* may selectively transmit the digital signal output by the ADC 141*b* to the multiplexer 120 to serve it as the information data 102.

Figure 9:
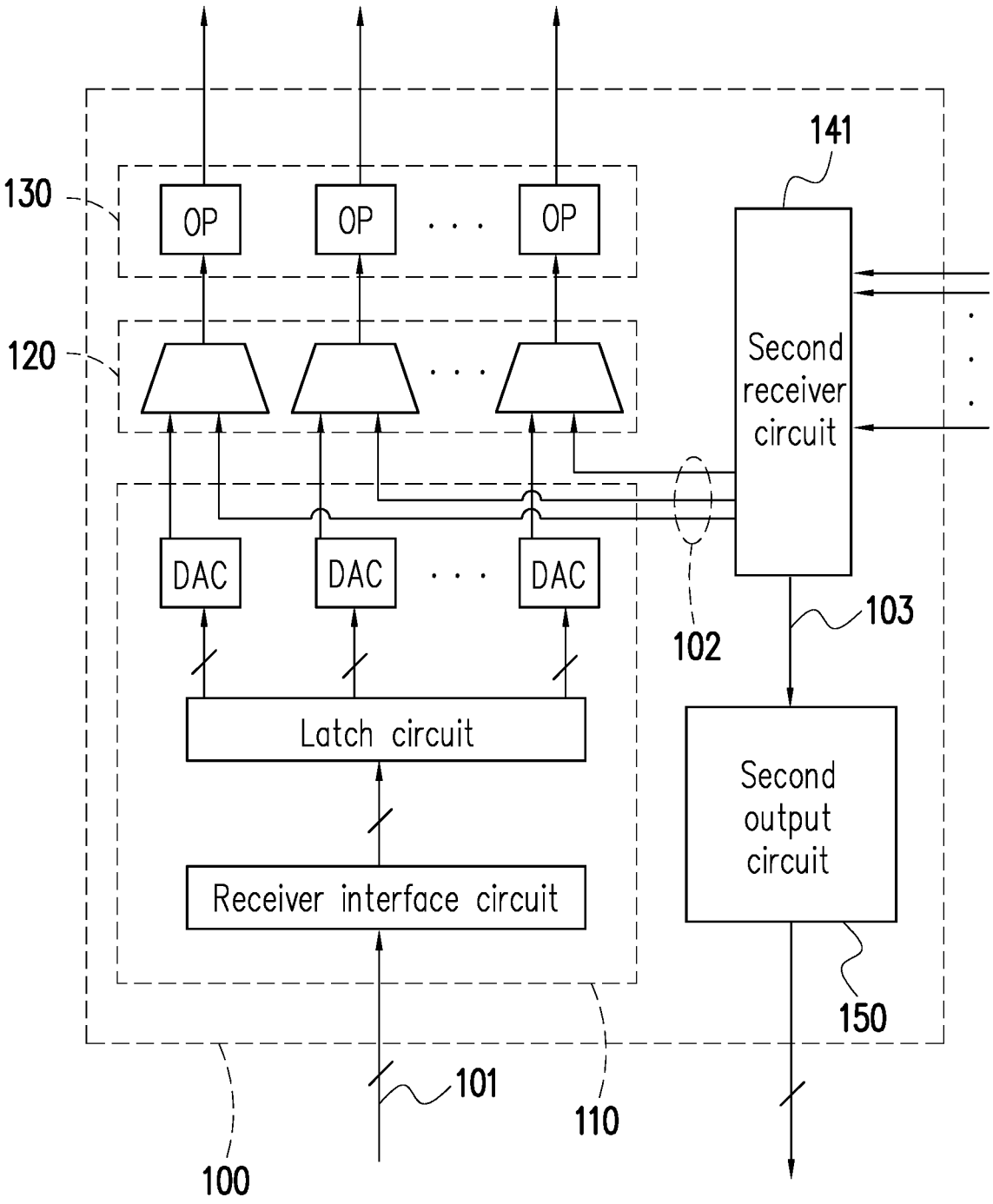
FIG. 9 is a schematic circuit block diagram illustrating the first receiver circuit, the multiplexer and the first output circuit depicted in FIG. 6A and FIG. 6B according to yet another embodiment of the invention.

FIG. 9 is a schematic circuit block diagram illustrating the first receiver circuit 110, the multiplexer 120 and the first output circuit 130 depicted in FIG. 6A and FIG. 6B according to yet another embodiment of the invention. The second receiver circuit 141 and the second output circuit 150 illustrated in FIG. 9 may refer to the related descriptions of those illustrated in FIG. 7 and/or FIG. 8 and thus, will not be repeatedly described.

In the embodiment illustrated in FIG. 9, the first receiver circuit 110 includes a receiver interface circuit, a latch circuit and at least one digital-to-analog converter (DAC). The receiver interface circuit of the first receiver circuit 110 may be a conventional data transmission interface circuit and thus, will not be repeatedly described. The latch circuit and the DAC of the first receiver circuit 110 may be inferred with reference to the related descriptions of the latch circuit 131 and the DACs 132_1 to 132_*n* illustrated in FIG. 7 and FIG. 8 and thus, will not be repeatedly described.

The multiplexer 120 is coupled to an output terminal of the digital-to-analog converter of the first receiver circuit 110 to receive the display data (i.e., the driving voltage) in the analog format. The multiplexer 120 is further coupled to the second receiver circuit 141 to receive the information data 102 (i.e., an information voltage) in an analog format. The first output circuit 130 includes a plurality of operational amplifiers (OPs). Input terminals of the operational amplifiers of the first output circuit 130 are respectively coupled to the at least one output terminal of the multiplexer 120. The operational amplifiers of the first receiver circuit 110 may be inferred with reference to the related descriptions of the OPs 133_1 to 133_*n* illustrated in FIG. 7 and FIG. 8 and thus, will not be repeatedly described.

In light of the foregoing, the driving apparatus for the display panel and the operation method thereof provided by the embodiments of the invention can achieve outputting the information data and the display data by sharing the first output circuit. The display data is configured to drive the display panel to present the image, while the information data is not configured to drive the display panel to present the image. Namely, the information data can be any information related to the driving apparatus, but not include pixel data. Thus, in some embodiments, the driving apparatus and the operation method thereof can achieve transmitting the complex information data on the premise that no additional pins are required, thereby saving the pin count. On the other hand, in some embodiments, the plurality of output channels of the first output circuit can simultaneously output the information data. Thus, the driving apparatus and the operation method thereof can achieve transmitting a great amount of information data within a short time, so as to save the transmission time of the information data. The saving of the transmission time can especially contribute to the efficiency of the testing procedure of integrated circuits.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving apparatus to drive a display panel, comprising:

a multiplexer, comprising a first input terminal to receive digital information data, a second input terminal to receive display data; and an output circuit, comprising an input terminal directly coupled to an output terminal of the multiplexer to convert digital data into an analog voltage and output the analog voltage via an output terminal of the output circuit, wherein when the driving apparatus operates in a second mode, the output circuit converts the display data into a driving voltage to drive the display panel, and the digital information data is not used for driving the display panel to present an image.

2. The driving apparatus according to claim 1, further comprising an information data circuit, wherein the information data circuit provides the digital information data.

3. The driving apparatus according to claim 2, wherein the information data circuit comprises a receiver circuit, wherein the receiver circuit converts a voltage or current sensing result of the display panel into sensing data in a first mode.

4. The driving apparatus according to claim 1, further comprising a receiver circuit, wherein the receiver circuit receives the display data for driving the display panel to present an image in a first mode.

5. The driving apparatus according to claim 1, wherein the driving apparatus is further coupled to an external device to provide external information for the driving apparatus to obtain the digital information data.

6. The driving apparatus according to claim 5, wherein the external device is a timing controller.

7. The driving apparatus according to claim 5, wherein the external device is the display panel.

8. The driving apparatus according to claim 5, wherein the external device is a test apparatus.

9. The driving apparatus according to claim 1, wherein the output circuit comprises:

an operational amplifier having an input terminal coupled to the output terminal of the multiplexer.

10. The driving apparatus according to claim 9, wherein the output circuit further comprises:

a digital-to-analog converter coupled between the output terminal of the multiplexer and the input terminal of the operational amplifier.

11. A driving apparatus to drive a display panel, comprising:

a first receiver circuit;

a second receiver circuit;

a multiplexer, comprising a first input terminal coupled to the first receiver circuit to receive first data and a second input terminal coupled to the second receiver circuit to receive second data and an output terminal, and an output circuit, comprising an input terminal directly coupled to the output terminal of the multiplexer to convert digital data into an analog voltage and output the analog voltage via an output terminal of the output circuit, wherein when the driving apparatus operates in a particular mode, the output circuit converts the first data into a driving voltage to drive the display panel, and the second data is not used for driving the display panel to present an image.

12. The driving apparatus according to claim 11, wherein the first data comprises display data for the output circuit to convert to the driving voltage for driving the display panel to present an image.

13. The driving apparatus according to claim 12, wherein the second data comprises digital information data not used for driving the display panel to present the image.

14. The driving apparatus according to claim 13, wherein the driving apparatus is further coupled to an external device and provide external information for the driving apparatus to obtain the digital information data.

15. The driving apparatus according to claim 14, wherein the external device is a timing controller.

16. The driving apparatus according to claim 14, wherein the external device is the display panel.

17. The driving apparatus according to claim 14, wherein the external device is a test apparatus.

18. The driving apparatus according to claim 11, wherein the output circuit comprises:

an operational amplifier having an input terminal coupled to the output terminal of the multiplexer.

19. The driving apparatus according to claim 18, wherein the output circuit further comprises:

a digital-to-analog converter coupled between the output terminal of the multiplexer and the input terminal of the operational amplifier.

* * * * *